US010724352B2

(12) United States Patent
Livescu et al.

(10) Patent No.: US 10,724,352 B2
(45) Date of Patent: Jul. 28, 2020

(54) PRESSURE PULSES FOR ACID STIMULATION ENHANCEMENT AND OPTIMIZATION

(71) Applicant: Baker Hughes, a GE company, LLC, Houston, TX (US)

(72) Inventors: Silviu Livescu, Calgary (CA); Timothy T. Ramsey, The Woodlands, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 154 days.

(21) Appl. No.: 16/015,434

(22) Filed: Jun. 22, 2018

(65) Prior Publication Data

US 2019/0390540 A1 Dec. 26, 2019

(51) Int. Cl.

| | |
|---|---|
| ***E21B 7/18*** | (2006.01) |
| ***E21B 28/00*** | (2006.01) |
| ***E21B 43/25*** | (2006.01) |
| ***C09K 8/60*** | (2006.01) |
| ***E21B 43/26*** | (2006.01) |
| ***E21B 49/00*** | (2006.01) |

(52) U.S. Cl.
CPC ..... *E21B 43/26* (2013.01); *E21B 49/00* (2013.01)

(58) Field of Classification Search
CPC . E21B 28/00; E21B 43/25; E21B 7/18; C09K 8/60
See application file for complete search history.

(56) References Cited

U.S. PATENT DOCUMENTS 5,006,044 A * 4/1991 Walker, Sr. ..... E21B 47/0008 417/12
5,341,345 A * 8/1994 Warner ..... E21B 47/082 367/99
8,813,838 B2 * 8/2014 Cavender ..... E21B 33/13 166/177.1
9,181,788 B2 11/2015 Ageev et al.
9,410,405 B2 8/2016 Ayers et al.
9,567,819 B2 2/2017 Cavender et al.
9,567,840 B2 * 2/2017 Parker ..... E21B 43/25
9,611,724 B2 4/2017 Hunter et al.
9,803,442 B2 10/2017 Paulsen
9,885,797 B2 2/2018 Badri et al.
9,896,917 B2 2/2018 Sizonenko et al.
2011/0139441 A1 6/2011 Zolezzi Garreton
2012/0132416 A1 5/2012 Zolezzi-Garreton

FOREIGN PATENT DOCUMENTS

EP 2940245 A1 11/2015

OTHER PUBLICATIONS

Medina et al; Optimization of Matrix Acidizing With Fluids Diversion in Real-Time Using Distributed Temperature Sensing and Coild Tubing; SPE-173686-MS, Mar. 2015.

* cited by examiner

*Primary Examiner* — Catherine Loikith
(74) *Attorney, Agent, or Firm* — Parsons Behle & Latimer

(57) ABSTRACT

A wellbore system may include a work string and at least one downhole device connected to a portion of the work string, the downhole device configured to deliver a periodic stream of fluid to a portion of a wellbore. The system may further include at least one sensor configured to detect reflected energy pulses associated with the periodic stream of fluid. The at least one downhole device may be configured to modify a pressure of the periodic stream of fluid in real time based on the reflected energy pulses received in real time.

18 Claims, 4 Drawing Sheets

PRESSURE PULSES FOR ACID STIMULATION ENHANCEMENT AND OPTIMIZATION

FIELD OF THE DISCLOSURE

This application is generally related to the field of acid stimulation in a wellbore and, in particular, to pressure pulses for stimulation enhancement and optimization.

BACKGROUND

Acid stimulation may be performed in a well to remove damage to the wellbore and to increase its productivity, or inj ectivity, by enhancing the near-well permeability. Damage in a typical well may extend radially several feet, or more, away from the wellbore. As such, in order to permeate the formations surrounding the wellbore, acid may be sprayed at a high pressure. Formation heterogeneity may lead to uneven distribution or conformance of the acid. Optimal acid stimulation may be difficult because of several factors. For example, for oil reservoirs, acid has lower viscosity than oil, resulting in fingering or viscous instabilities. Further, acid tends to flow along the path of least resistance in the higher permeability zones, leaving the lower permeability zones unswept. Also, the downhole acid flow is usually diverted based on stimulation schedules, designed in the pre-job phase, that are not optimized based on the real reservoir heterogeneity. Even if the real reservoir properties are considered in the pre-job phase, the stimulation evaluation is typically done based only on post-stimulation productivity and injectivity increase.

Applying the acid by creating pressure pulses may improve the acid flow into a formation, even in damaged or lower permeability zones. However, determining an optimal pressure in real time for the pressure pulses at each position within the wellbore remains a problem. Further, pressure pulses created by some commercial pulse devices are asymmetric, having a sharp increase and a slow decrease. This may result in insufficient power to enable the acid to permeate the formation efficiently.

SUMMARY

Disclosed are systems and methods for using pressure pulses, such as those formed by the EasyReach Extended-Reach Tool™ and the Roto-Jet™ jetting tool, both offered commercially by Baker Hughes, a GE company of Houston, Tex., for acid stimulation enhancement. Further, the pressure pulses can be monitored in real time as a formation is stimulated enabling pressure rate changes on the fly to optimize acid stimulation. In an embodiment, a wellbore system includes a work string and at least one downhole device connected to a portion of the work string. The downhole device is configured to deliver a periodic stream of fluid to a portion of a wellbore. The system further includes at least one sensor configured to detect reflected energy pulses associated with the periodic stream of fluid. The at least one downhole device is configured to modify a pressure of the periodic stream of fluid in real time based on the reflected energy pulses received in real time.

In some embodiments, the downhole device includes a rotary jet tool. In some embodiments, the rotary jet tool is electrically actuated, hydraulically actuated, or both, and actuation of the rotary jet tool is based on the reflected energy pulses, on a location of the downhole device, on a flow rate of the periodic stream of fluid, or a combination thereof. In some embodiments, the downhole device comprises a fluidic oscillator tool. In some embodiments, the fluidic oscillator tool comprises a Coanda-effect oscillator device, an electrically actuated piston device, a hydraulically actuated piston device, or a combination thereof. In some embodiments, the fluid comprises acid or a two-phase fluid including acid and gas.

In some embodiments, the system includes a processor configured to associate the reflected energy pulses with a level of acid permeation of the portion of the wellbore and the system is configured to optimize the pressure of the periodic stream of fluid based on the permeation of the portion of the wellbore. In some embodiments, the periodic stream of fluid comprises substantially square pulses. In some embodiments, the periodic stream of fluid extends radially from the downhole device. In some embodiments, the work string comprises coil tubing. In some embodiments, the portion of the wellbore comprises at least one fracture in a formation.

In an embodiment, a method of performing acid stimulation includes positioning a downhole device adjacent a portion of a wellbore. The method further includes delivering a periodic stream of fluid from the downhole device to the portion of the wellbore. The method also includes detecting reflected energy pulses associated with the periodic stream of fluid. The method includes modifying a pressure of the periodic stream of fluid in real time based on the reflected energy pulses received in real time.

In some embodiment, the method further includes associating the reflected energy pulses with a level of acid permeation of the portion of the wellbore in real time, and optimizing the pressure of the periodic stream of fluid in real time based on the level of acid permeation of the portion of the wellbore.

In an embodiment, a wellbore system includes a work string comprising coil tubing. The system further includes at least one downhole device comprising a rotary jet tool or a fluidic oscillator tool connected to a portion of the work string, the downhole device configured to deliver a periodic stream of acid to a portion of a wellbore comprising at least one fracture formation. The system also includes at least one sensor configured to detect reflected energy pulses associated with the periodic stream of acid. The system includes a processor configured to associate the reflected energy pulses with a level of acid permeation of the portion of the wellbore in real time and to optimize a pressure of the periodic stream of acid in real time based on the level of acid permeation of the portion of the wellbore.

Figure 1:
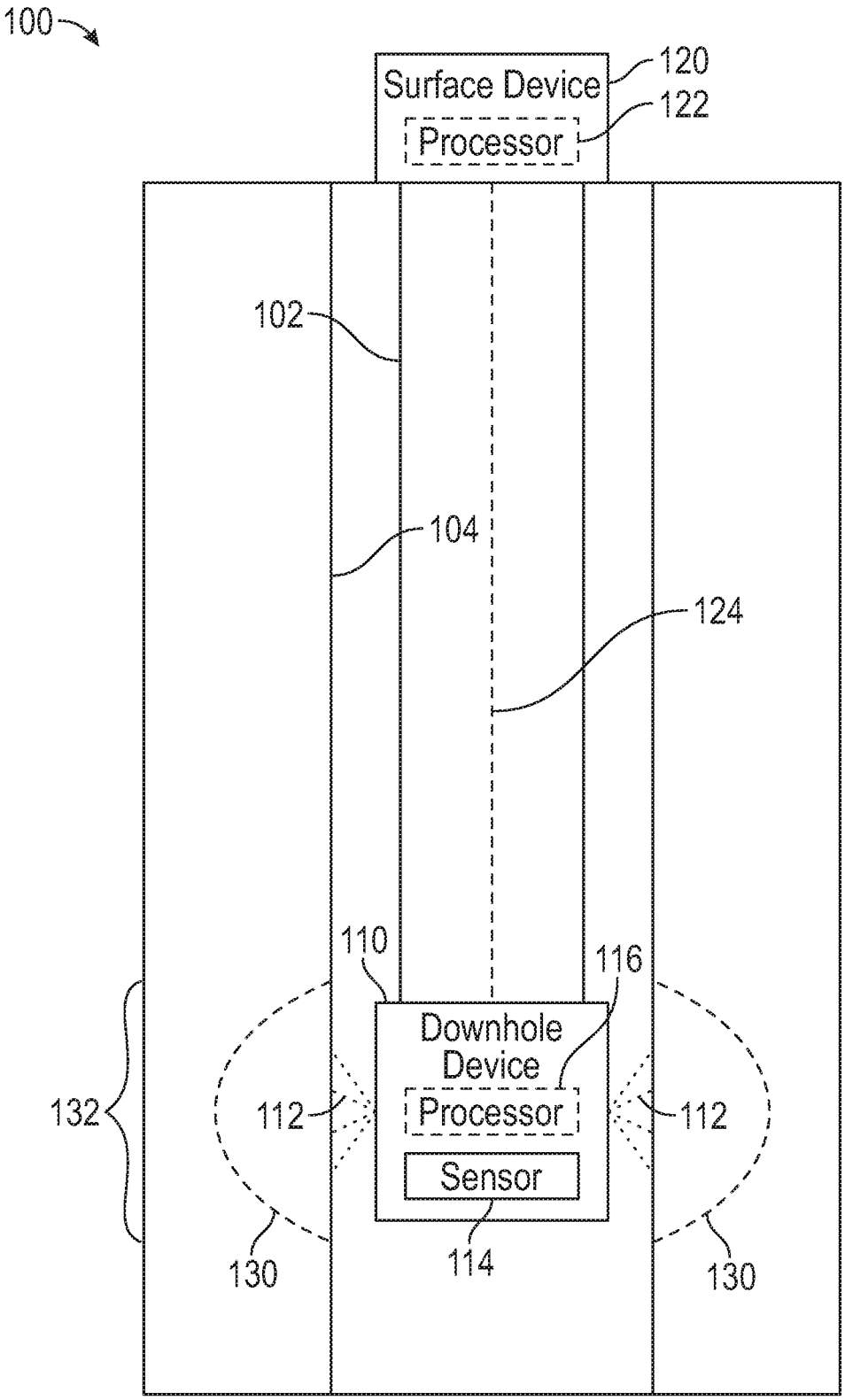
FIG. 1 is a block diagram depicting an embodiment of a wellbore system for pressure pulse acid stimulation.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the disclosure as defined by the appended claims.

DETAILED DESCRIPTION

Described are systems and methods for using pressure pulses, such as those created by a fluidic oscillator tool or by a rotary jet tool, for enhancing acid stimulation by vibrating the pore space in the near-well region. The systems and methods may further be used for optimizing acid stimulation by monitoring in real time the pressure pulses traveling into formation and the returned pressure response.

Acid pressure pulses generated by fluidic oscillator tools or by rotary jet tools may be highly effective in controlling acid injection into a formation because fluid displacement pulses may push acid into the formation by increasing the pore space. Further, the pressure gradients involved in typical flow of fluids through the reservoir are generally very small when viewed at the pore scale, yet small differences between these pressure gradients determine the path of least resistance that governs normal flow of fluids.

Referring to FIG. 1, an embodiment of a wellbore system 100 is depicted. The wellbore system 100 may include a work string 102 configured to be positioned within a wellbore 104. A downhole device 110, e.g. a coiled tubing conveyed tool, may be positioned using the work string 102 within the wellbore 104. The downhole device 110 may be used for acid stimulation of the wellbore 104. As such, the downhole device 110 may be configured to deliver a periodic stream of fluid 112, e.g. acid, to a portion 132 of the wellbore 104. The downhole device 110 may include a rotary jet tool or a fluidic oscillator tool, as described further herein. The portion 132 of the wellbore 104 may include at least one fracture formation. The periodic stream of fluid 112 may include acid alone or, in some cases, a two-phase fluid that includes acid and a gas, such as carbon dioxide and/or nitrogen. The acid may be included in a foam that can be pumped into a formation.

The work string 102 may be various types work strings or combinations of various types of works strings such as wireline, coiled tubing, or jointed tubing as would be appreciated by one of ordinary skill in the art having the benefit of this disclosure.

The downhole device 110 may include at least one sensor 114 configured to detect reflected energy pulses associated with the periodic stream of fluid 112. In higher permeability zones, the reflected energy pulses may be weaker as opposed to lower permeability zones. By detecting the strength of energy pulses, the sensor 114 may provide real time data that may be correlated to a level of acid permeation. The sensor 114 may record and/or analyze the reflective energy pulses to determine in real-time various characteristics of the fracture and/or wellbore as will be discussed herein. The sensor 114 could be used to determine a level of acid permeation 130 within the wellbore. The sensor 114 may be connected to the downhole device 110 and may be a battery-powered sensor positioned within the wellbore.

The downhole device 110 may optionally include a processor 116. The sensor 114 positioned within the wellbore 104 may process measurements from the energy pulses at the processor 116. Alternatively or in addition, a surface device 120 may include a processor 122 and a communication medium 124 may enable data detected by the sensor 114 to be processed at the processor 122. For example, the communication medium 124 may include various mechanisms such as an e-line within or along the work string 102. The sensor 114 positioned within the wellbore could transmit measurements to the surface via other mechanisms such as via TELECOIL™ offered commercially by Baker Hughes, a GE company of Houston, Tex.

During operation, the downhole device 110 may deliver a periodic stream of fluid 112 to the portion 132 of the wellbore 104. The sensor 114 may detect reflected energy pulses associated with the periodic stream of fluid 112 as it interacts with the wellbore 104. In some embodiments, the processor 116 may associate the reflected energy pulses with a level of acid permeation 130. As such, the pressure of the periodic stream of fluid 112 may be adjusted in real time and optimized based on the permeability of the wellbore 104 at the portion 132. Additional portions of the wellbore 104 may be associated with different pressures in order to achieve an even distribution of acid along the length of the wellbore 104.

A benefit of the system 100 is that uniform acid permeation may be achieved using real time data to optimize application of the acid within a wellbore 104. Other benefits and/or advantages may exist.

Figure 2:
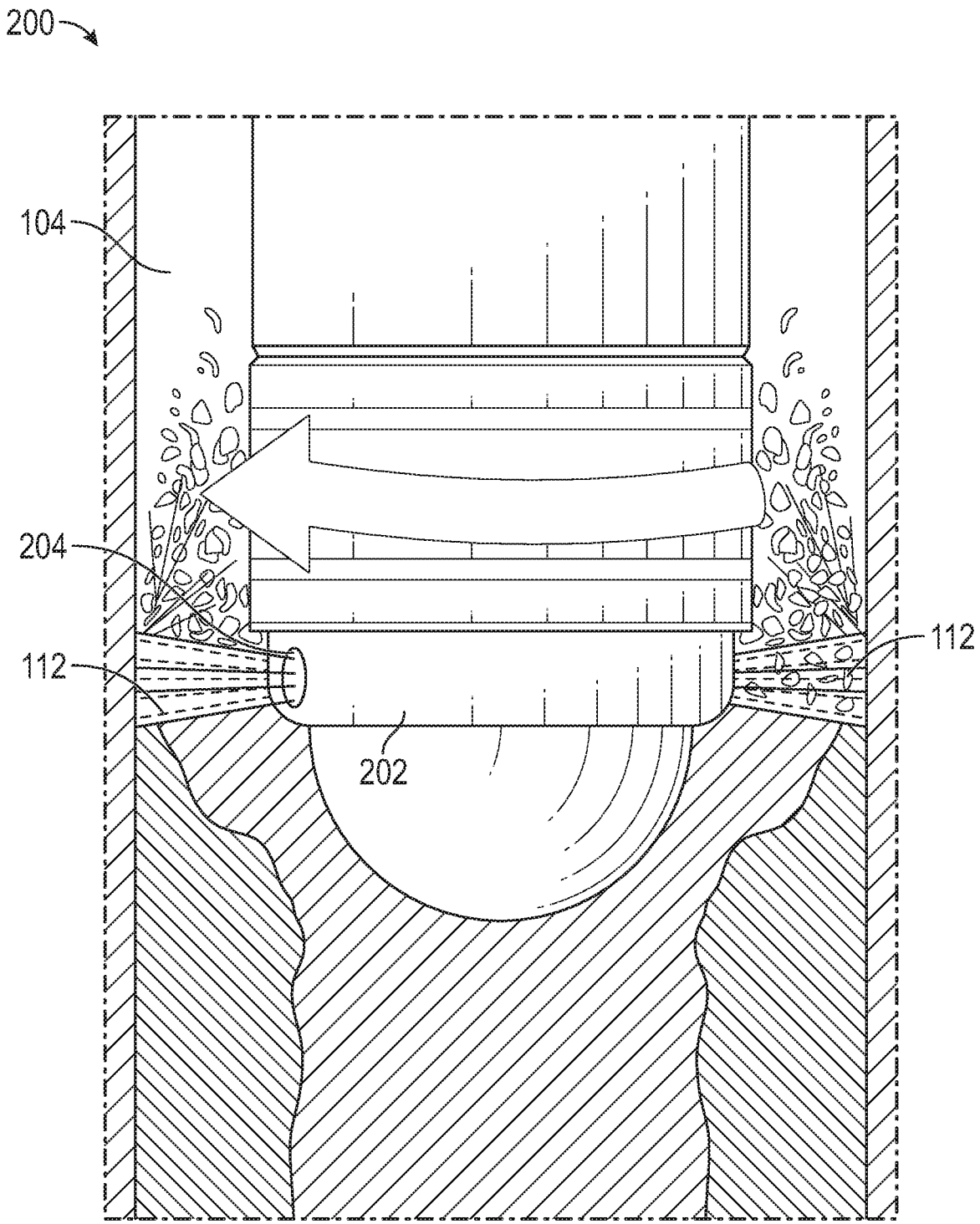
FIG. 2 is an embodiment of a downhole device usable for pressure pulse acid stimulation including a rotary jet tool.

Referring to FIG. 2, an embodiment of the downhole device 110 may include a rotary jet tool 200. As a non-limiting example, the rotary jet tool 200 may be a Roto-Jet™ jetting tool offered commercially by Baker Hughes, a GE company of Houston, Tex. The rotary jet tool 200 may produce the periodic stream of fluid 112 by use of a spinning mechanism. For example, the tool 200 may include a rotating jetting nozzle 202 having one or more radial jets 204. The radial jets 204 may rotate relative to the wellbore 104 to create the periodic stream of fluid 112. The periodic stream of fluid 112 may extend radially from the downhole device 200. The strong periodic pulses of the periodic stream of fluid 112 may generate reflected energy within the wellbore.

The rotary jet tool 200 may be electrically and/or hydraulically actuated. Further, actuation of the rotary jet tool 200 may be stopped and started based on a sensed formation response, e.g., using the sensor 114, and further based on a location of the downhole device 110, and/or based on a flow rate of the periodic stream of fluid. This control of the rotary jet tool 200 may enable optimization of acid penetration into the formation. The rotary jet tool 200 may be powered from the surface, for example, by the surface device 120 (shown in FIG. 1). Alternatively, the fluidic oscillator tool 300 may be powered from a battery (not shown) within the downhole device 110 (shown in FIG. 1).

The reflected energy from the produced stream of acid may be detected by a sensor 114 (shown in FIG. 1) and processed to determine the acid permeation 130 (shown in FIG. 1) of the wellbore 104. The pressure of the periodic stream of acid 112 through the rotary jet tool 200 may then be adjusted to optimize the acid permeation 130 through the entire wellbore 104.

Figure 3:
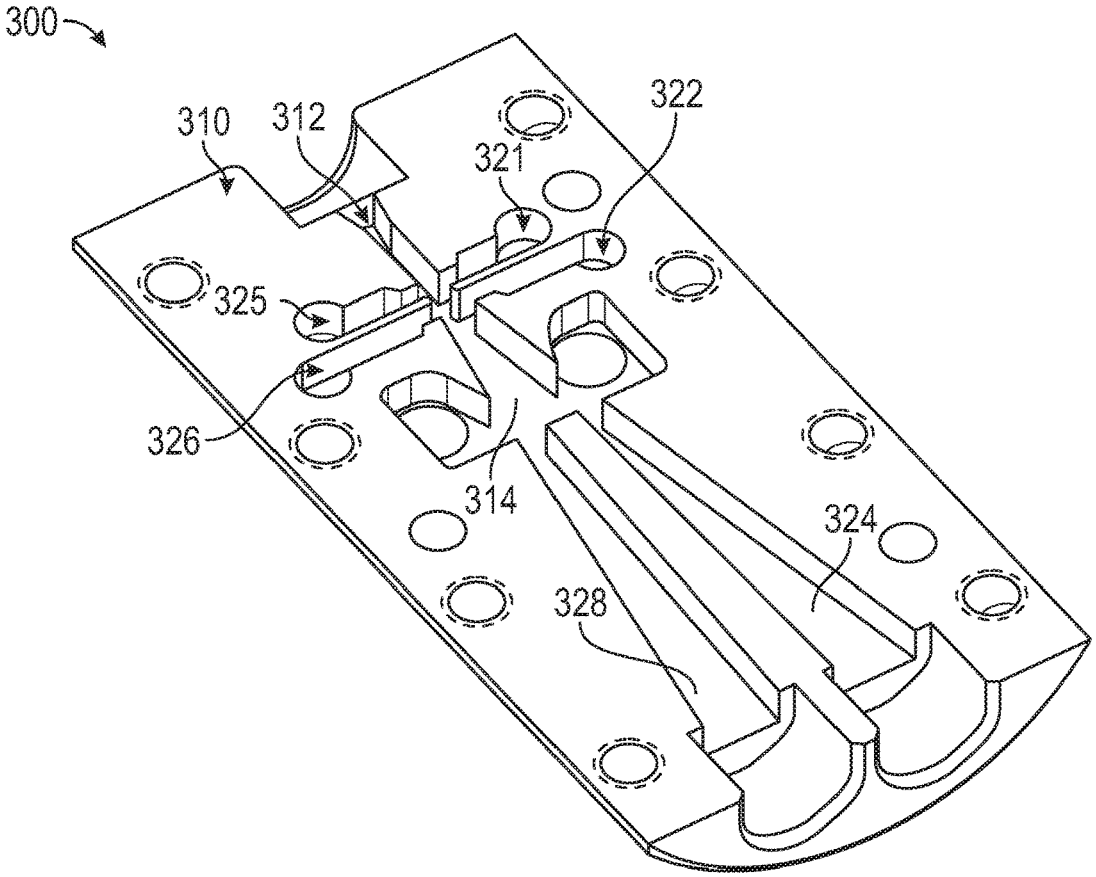
FIG. 3 is an embodiment of a downhole device usable for pressure pulse acid stimulation including a fluidic oscillator tool.

Referring to FIG. 3, another embodiment of the downhole device 110 may include a fluidic oscillator tool 300 to provide the periodic stream of fluid 112 (shown in FIG. 1). A portion of the fluidic oscillator 300 is shown in FIG. 3. The fluidic oscillator tool 300 may operate as Coanda-effect oscillator device, relying on the Coanda-effect to alternate a flow of high-pressure fluid (e.g., acid) through different channels. As a non-limiting example, the vibratory device may be a fluid hammer tool such as the EasyReach Extended-Reach Tool™ offered commercially by Baker Hughes, a GE company of Houston, Tex. A detailed description of a fluidic oscillator tool 300 is provided in U.S. Pat. No. 8,727,404, hereby incorporated by reference in its entirety.

FIG. 3 shows a portion 310 of a fluidic oscillator tool 300 which may include an input power port 312 through which fluid is input into the tool 300. Fluid pumped down a work string 102 may enter the fluidic oscillator tool 300 through the input power port 312. The tool 300 may further include a first power path 324 and a second power path 328 that are both connected to the input power port 312 via a connecting power path 314. The fluid flowing through the tool 300 will alternate between flowing down the first power path 324 and the second power path 328 due to the Coanda effect based on fluid inputs from triggering paths 322, 326 and feedback paths 321, 325 as detailed in U.S. Pat. No. 8,727,404 with the alternate flow being used to create periodic stream of fluid 112.

The fluidic oscillator tool 300, having the portion 310, may produce the periodic stream of fluid 112 (shown in FIG. 1). Reflected energy from the produced stream of acid may be detected by the sensor 114 and processed to determine the acid permeation 130 of the wellbore 104. The pressure of the periodic stream of acid through the fluid oscillator tool 300 may then be adjusted to optimize the acid permeation 130 through the entire wellbore 104.

In some embodiments, the fluidic oscillator tool 300 may include piston vibratory device, such as an electrically actuated piston device, a hydraulically actuated piston device, or a combination thereof. In this case, the fluidic oscillator tool 300 may be powered from the surface, for example, by the surface device 120 (shown in FIG. 1). Alternatively, the fluidic oscillator tool 300 may be powered from a battery (not shown) within the downhole device 110 (shown in FIG. 1).

Figure 4:
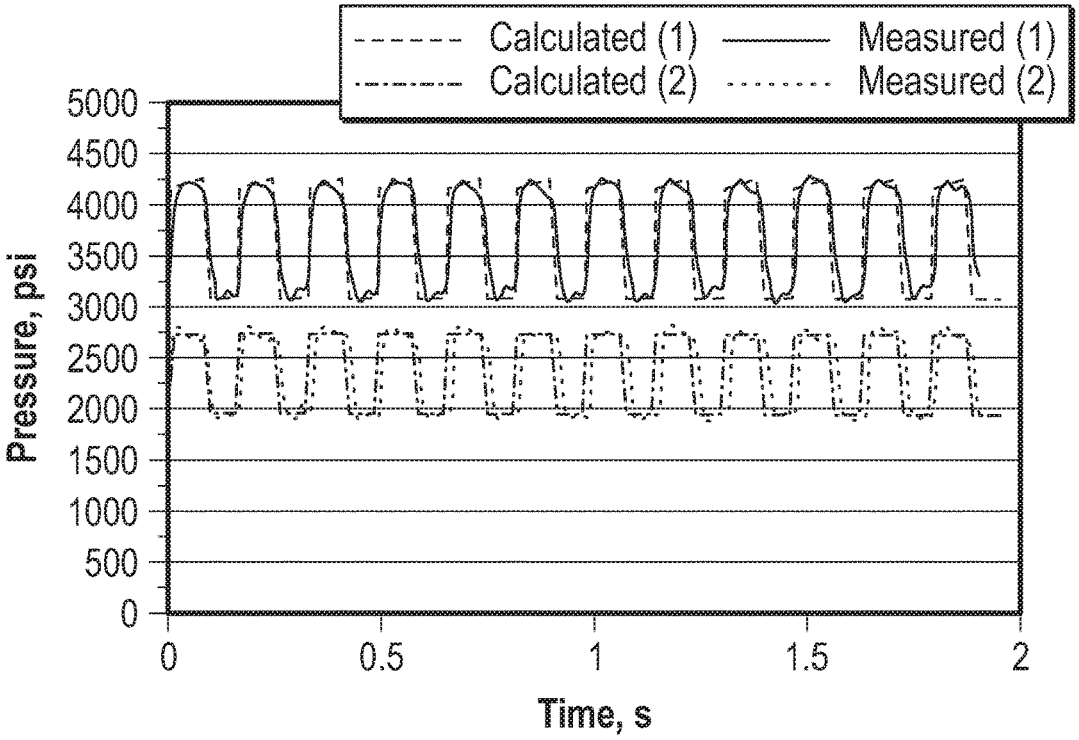
FIG. 4 is a pattern of an embodiment of the periodic fluid stream.

Referring to FIG. 4, a pattern of an embodiment of the periodic fluid stream is depicted. The pattern may be typical of pressure pulses generating using an EasyReach™ fluid hammer tool at surface pumping rates of 1.5 bpm and 3 bpm. FIG. 4 shows that the EasyReach™ tool is able to generate consistent energy pulses as indicated by the measured pressure pulses at 1.5 bpm and 3 bpm surface pumping rates.

In general, the EasyReach™ tool is capable of creating pressure pulses with amplitudes of more than 1,000 psi. The Roto-Jet™ jetting tool is capable of pressure amplitudes of more than 3,000 psi. The vibration energy created by squared pressure pulses, generated by a rotary jet tool and/or a fluidic oscillator tool are may be more powerful than typical pulse generators, which may have asymmetric pressure pulses with a sharp increase and a slow decrease in pressure. In contrast, the downhole device 110 may be capable of creating substantially square pulses. As used herein, the term substantially square means the pulses have distinct corners where the rise times equal the drop times.

Figure 5:
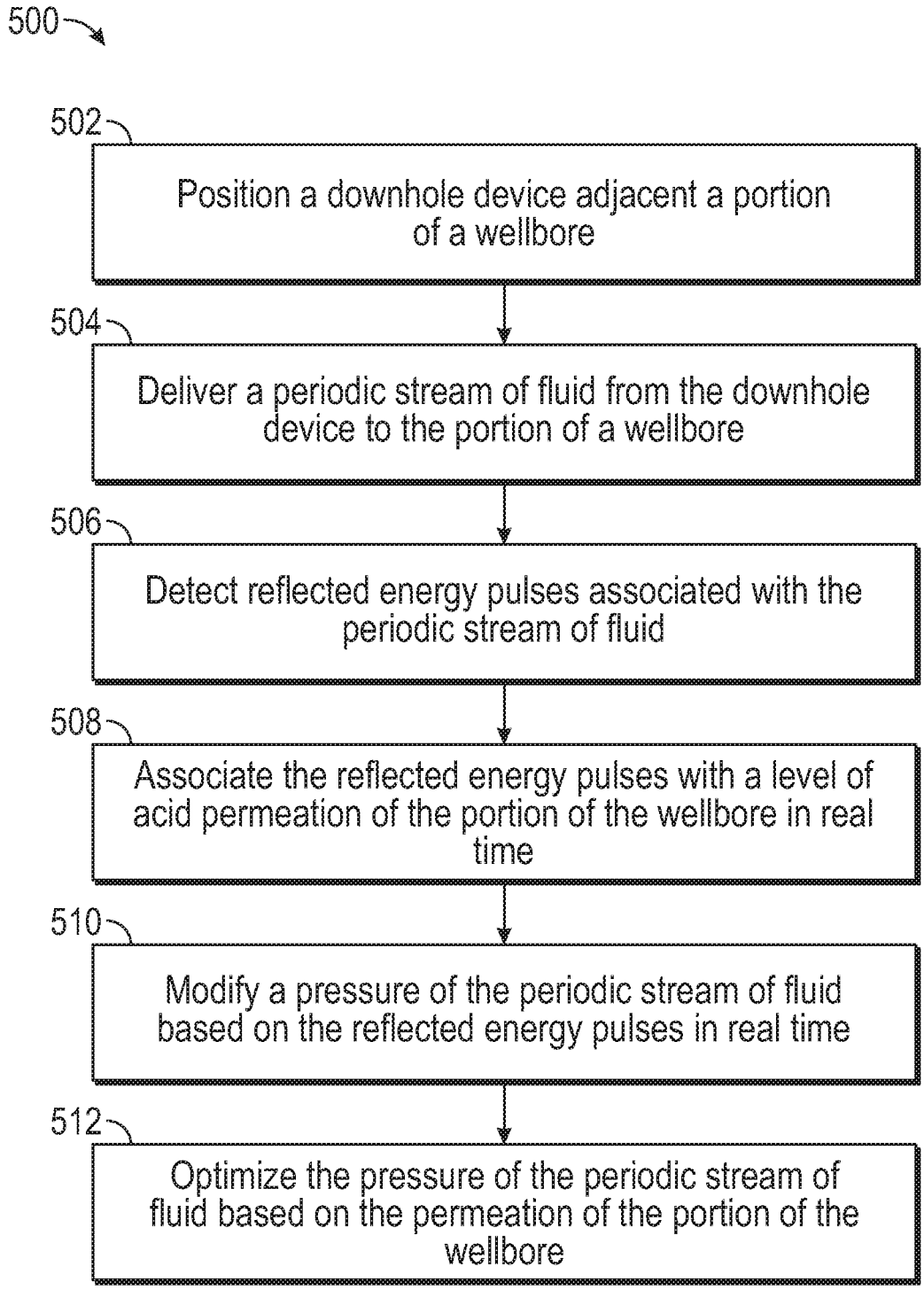
FIG. 5 is an embodiment of a method for pressure pulse acid stimulation.

Referring to FIG. 5, an embodiment of a method 500 for pressure pulse acid stimulation is depicted. The method 500 may include positioning a downhole device adjacent a portion of a wellbore, at 502. For example, the downhole device 110 may be positioned adjacent to the portion 132 of the wellbore 104.

The method 500 may further include delivering a periodic stream of fluid from the downhole device to the portion of a wellbore, at 504. For example, the downhole device 110 may deliver the periodic stream of fluid 112 to the portion 132 of the wellbore 104.

The method 500 may also include detecting reflected energy pulses associated with the periodic stream of fluid, at 506. For example, the sensor 114 may detect reflected energy pulses associated with the periodic stream of fluid 112 as it interacts with the wellbore 104.

The method 500 may include associating the reflected energy pulses with a level of acid permeation of the portion of the wellbore, at 508. For example, the reflected energy pulses may be associated with the level of acid permeation 130.

The method 500 may further include modifying a pressure of the periodic stream of fluid based on the reflected energy pulses, at 510. For example, the pressure of the periodic stream of fluid 112 may be modified in real time.

The method 500 may also include optimizing the pressure of the periodic stream of fluid based on the permeation of the portion of the wellbore, at 512. For example, the periodic stream of fluid 112 may be optimized to achieve uniform acid permeation along the wellbore 104.

A benefit of the method 500 is that uniform acid permeation may be achieved within a wellbore independent from the uniformity permeability of a formation of the wellbore. Other benefits and/or advantages may exist.

Although various embodiments have been shown and described, the present disclosure is not so limited and will be understood to include all such modifications and variations as would be apparent to one skilled in the art.

What is claimed is:

1. A wellbore system comprising:

a work string;

at least one downhole device connected to a portion of the work string, the downhole device configured to deliver a periodic stream of fluid to a portion of a wellbore, wherein the fluid is acidic;

at least one sensor configured to detect reflected energy pulses associated with the periodic stream of fluid; and a processor configured to associate the reflected energy pulses with a level of acid permeation of the portion of the wellbore, wherein the at least one downhole device is configured to modify a pressure of the periodic stream of fluid in real time based on the reflected energy pulses received in real time, and wherein the system is configured to optimize the pressure of the periodic stream of fluid based on the permeation of the portion of the wellbore.

2. The system of claim 1, wherein the downhole device comprises a rotary jet tool.

3. The system of claim 2, wherein the rotary jet tool is electrically actuated, hydraulically actuated, or both, and wherein actuation of the rotary jet tool is based on the reflected energy pulses, on a location of the downhole device, on a flow rate of the periodic stream of fluid, or a combination thereof.

4. The system of claim 1, wherein the downhole device comprises a fluidic oscillator tool.

5. The system of claim 4, wherein the fluidic oscillator tool comprises a Coanda-effect oscillator device, an electrically actuated piston device, a hydraulically actuated piston device, or a combination thereof.

6. The system of claim 1, wherein the fluid comprises acid, a two-phase fluid including acid and gas, a foam including acid, or a combination thereof.

7. The system of claim 1, wherein the periodic stream of fluid comprises substantially square pulses.

8. The system of claim 1, wherein the periodic stream of fluid extends radially from the downhole device.

9. The system of claim 1, wherein the work string comprises coil tubing.

10. The system of claim 1, wherein the portion of the wellbore comprises at least one fracture in a formation.

11. A method of performing acid stimulation comprising:

positioning a downhole device adjacent a portion of a wellbore;

delivering a periodic stream of fluid from the downhole device to the portion of the wellbore, wherein the fluid is acidic;

detecting reflected energy pulses associated with the periodic stream of fluid;

associating the reflected energy pulses with a level of acid permeation of the portion of the wellbore in real time; and modifying a pressure of the periodic stream of fluid in real time based on the reflected energy pulses received in real time and optimizing the pressure of the periodic stream of fluid in real time based on the level of acid permeation of the portion of the wellbore.

12. The method of claim 11, wherein the downhole tool comprises a rotary jet tool.

13. The method of claim 11, wherein the downhole tool comprises a fluidic oscillator tool.

14. The method of claim 13, wherein the fluidic oscillator tool comprises a Coanda-effect oscillator device.

15. The method of claim 11, wherein the periodic stream of fluid comprises substantially square pulses.

16. The method of claim 11, wherein the periodic stream of fluid extends radially from the downhole device.

17. The method of claim 11, wherein the downhole device is positioned using coil tubing.

18. A wellbore system comprising:

a work string comprising coil tubing;

at least one downhole device comprising a rotary jet tool or a fluidic oscillator tool connected to a portion of the work string, the downhole device configured to deliver a periodic stream of acid to a portion of a wellbore comprising at least one fracture formation;

at least one sensor configured to detect reflected energy pulses associated with the periodic stream of acid; and a processor configured to associate the reflected energy pulses with a level of acid permeation of the portion of the wellbore in real time and to optimize a pressure of the periodic stream of acid in real time based on the level of acid permeation of the portion of the wellbore.

* * * * *